US005669723A

United States Patent [19]

Chang

[11] Patent Number: 5,669,723

[45] Date of Patent: Sep. 23, 1997

[54] KEY ASSEMBLY FOR COMPUTER KEYBOARD

[75] Inventor: Joe Chang, Taipei, Taiwan

[73] Assignee: Behavior Technical Computer Corp., Taipei, Taiwan

[21] Appl. No.: 622,658

[22] Filed: Mar. 26, 1996

[51] Int. Cl.[6] ..... B41J 5/16

[52] U.S. Cl. ..... 400/496; 400/495

[58] Field of Search ..... 400/496, 495

[56] References Cited

U.S. PATENT DOCUMENTS

| | | | |
|---|---|---|---|
| 3,962,556 | 6/1976 | Kravchuck | 400/496 |
| 4,010,838 | 3/1977 | Sims, Jr. | 400/496 |
| 4,802,779 | 2/1989 | Allaire | 400/496 |

OTHER PUBLICATIONS

Harris, R.H. Counterweight Space Bar Bechanism. IBM Technical Disclosure Bulletin; vol. 20, No. 4. Sep. 1977.

*Primary Examiner*—John S. Hilten

*Assistant Examiner*—Leslie Grohusky

*Attorney, Agent, or Firm*—Kirkpatrick & Lockhart LLP

[57] ABSTRACT

A key assembly, particularly a space bar assembly for a computer keyboard, consists of an elongate cap, an actuating post and two locating posts integrally formed on a bottom of the cap and located respectively at a center and two ends thereof, a key base mounted on an IC board to receive the actuating post, two locating walls mounted on the IC board to receive the locating posts and respectively defining a slot, two mounting seats mounted on the IC board and located respectively near the locating posts and defining respectively a snapping closure, a U-shaped support member having two parallel portions extending through the slots and an intermediate portion snappingly received in the snapping closures.

3 Claims, 3 Drawing Sheets

KEY ASSEMBLY FOR COMPUTER KEYBOARD

FIELD OF THE INVENTION

The present invention is related to an improved key assembly for a computer keyboard, particularly to an improved space bar assembly, wherein the space bar assembly can be operated quietly and assembled and disassembled very easily and quickly.

BACKGROUND OF THE INVENTION

A conventional key assembly for a computer keyboard has an actuating post integrally formed with a cap. The actuating post is extended into a hole defined by a key base and may have a reciprocal movement in relation thereto. When the cap of the key is pressed, the actuating post is moved downwardly to activate an electrical contact. Such a conventional key assembly performs well when it is used for a common key. However, when it is used for a space bar which has a length several times that of the common key, problems may occur. For example, when the space bar is not pressed about its central point, the activating post may be inclinedly moved within the key base and blocked by a wall thereof so that the activating post cannot effectively activate the electrical contact, or it may be engaged with a corner of the key base so that it cannot be automatically rebounded to its original position even if the pressing force is released. Furthermore, the conventional key assembly which has an unstable supporting feature also causes the problems of vibration and noise when it is operated.

To overcome the problems of the conventional space bar assembly, an improvement is proposed to fixedly connect two ends of a supporting member located on a bottom of the cap of the space bar to two supporting seats which are fixedly mounted on an IC board in the keyboard. However, such an improvement still has problems. For example, due to the two ends of the supporting member being connected to the supporting seats in a fixed manner, it is very inconvenient to assemble the cap. Furthermore, the problems of vibration and noise when the space bar is operated still cannot be overcome.

The present invention therefore is aimed to provide an improved key assembly, particularly an improved space bar assembly to mitigate and/or obviate the aforementioned problems.

SUMMARY OF THE INVENTION

One object of the present invention is to provide a key assembly, particularly a space bar assembly, which can be operated with a low vibration and noise.

Another object of the present invention is to provide a key assembly, particularly a space bar assembly, which can be assembled or disassembled very quickly and conveniently.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
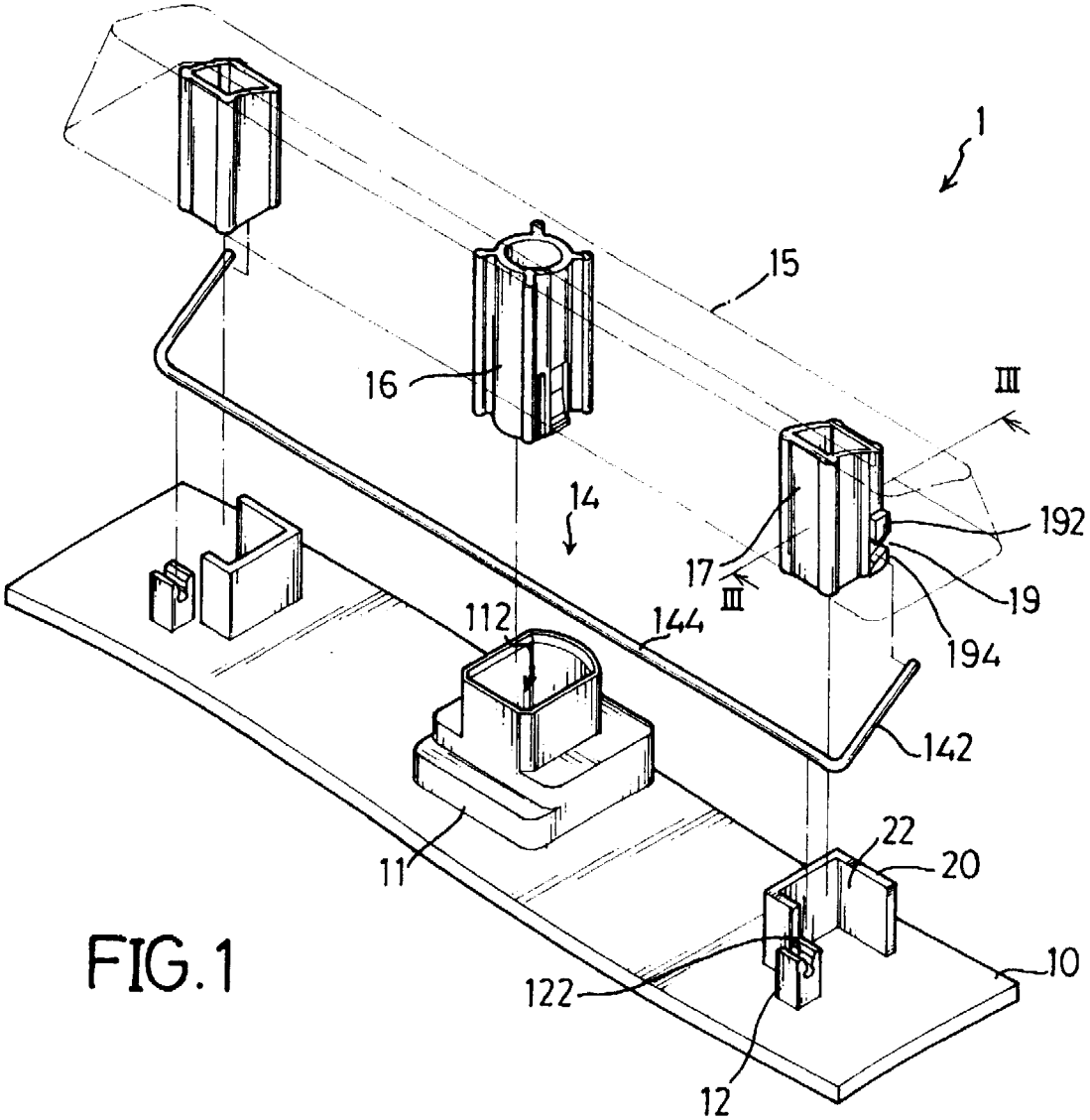
FIG. 1 is a front-right-top perspective, exploded view, showing a space bar assembly for a computer keyboard, wherein the space bar assembly is intended to be mounted on an IC board in the keyboard.

Referring to FIG. 1, a space bar assembly for a computer keyboard (not shown) in accordance with the present invention is generally indicated by reference number 1. The space bar assembly 1 is mounted on an IC board 10 in the keyboard. Like a conventional space bar assembly, the present space bar assembly 1 also comprises an elongate cap 15 (shown by phantom lines) by which fingers of a user can manipulate the space bar assembly 1 and an actuating post 16 fixedly mounted on a bottom face of the cap 15 and located in a center thereof which is used to activate an electrical contact when the cap 15 is pressed.

However, the present key assembly 1 further comprises two locating posts 17 mounted on the bottom face of the cap 15 and located respectively near an extreme right position and an extreme left position thereof. Each locating post 17 has integrally formed an upper and a lower mounting block 192, 194 defining a mounting slot 19 therebetween, which can be better seen and will be disclosed in detail in reference to FIGS. 3 and 4.

A hollow key base 11 which is mounted on the IC board 10 and located substantially corresponding to that of the actuating post 16, defines a hole 112 extending therethrough for receiving the actuating post 16 to have a reciprocal movement therein. A resilient member (not shown) is provided in the hole 112 for springing the cap 15 back to its original position when the force pressing the cap 15 is released.

Furthermore, two locating walls 20 are mounted on the IC board 10 and located substantially corresponding to the locating posts 17. Each locating wall 20 has a substantially L-shaped configuration to define a space 22 for receiving the locating posts 17 to move therein. Two mounting seats 12 are respectively mounted on a rear side (front side as seen from FIG. 1) of the L-shaped locating wall 20. Each mounting seat 12 defines a snapping closure 122 on a top thereof.

Figure 2:
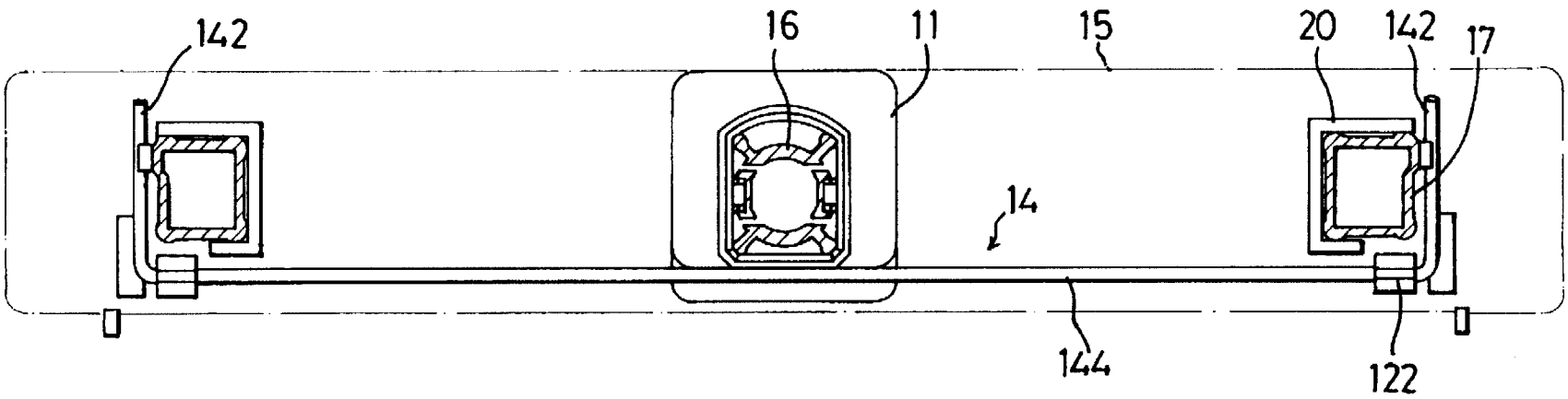
FIG. 2 is a top view of the space bar assembly of FIG. 1 with the IC board being removed.

Also referring to FIG. 2, a generally U-shaped supporting member 14 which defines two parallel side portions 142 and an intermediate portion 144 connected therewith is mounted to the space bar assembly 1 by extending the two parallel side portions 142 respectively through the slots 19 and pivotably mounting two ends of the intermediate portion 144 into the snapping closures 122 while a central part of the bottom portion 144 is located closely adjacent to a rear side of the key base 11 (better seen in FIG. 2). The two ends of the intermediate portion 144 of the supporting member 14 are snappingly received in the snapping closures 122.

From FIG. 2, it can be clearly seen that the provision of the locating posts 17 which are matingly engaged with the locating walls 20 can help the actuating post 16 to be more stably received in the hole 112 (FIG. 1) defined by the key base 11. Furthermore, when the cap 15 (shown by phantom lines) is pressed, no matter whether the pressing force is exerted on any portion of the cap 15, the pressing force can be transmitted to the entire length of the cap 15 through the aid of the supporting member 14; thus, an inclination of the cap 15 when the pressing force is not centrally exerted on the cap 15 will not happen; the actuating post 16 can always smoothly travel in the hole 112 defined by the key base 11; thus, problems of vibration and noise in a prior art space bar assembly are not found in the present space bar.

Furthermore, there is no fixed connection between the supporting member 14 and the cap 15 and the mounting seats 12; thus, the assembly and disassembly of the space bar assembly 1 can be very quick and convenient.

Figure 4:
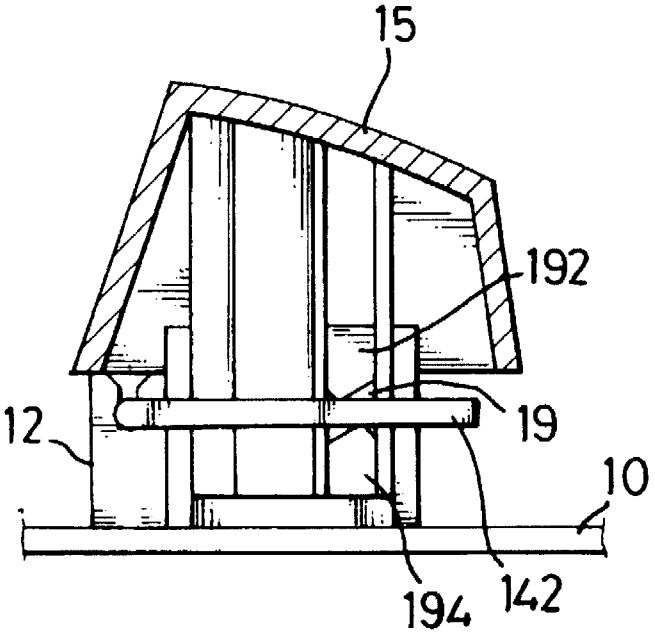
FIG. 4 is a view similar to FIG. 4, but showing that the space bar being pressed.
Figure 3:
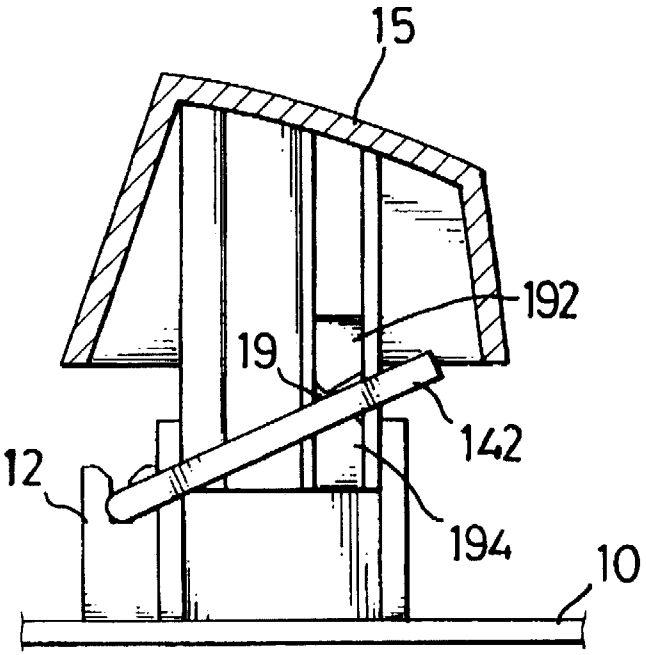
FIG. 3 is cross-sectional view taken along line III—III of FIG. 1, with the IC board being removed.

Referring to FIGS. 3 and 4, the mounting slot 19 is defined by confronting ends respectively of the upper and lower mounting blocks 192, 194. Each of the confronting ends is defined by an inclined short side and an inclined long side intersecting on an apex wherein the short sides are aligned with each other while the long sides are parallel to and spaced from each other a distance, whereby the slot 19 can have enlarged opening ends to facilitate the side portions 142 of the supporting member 14 to be extended into the slots 19.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

I claim:

1. A key assembly, particularly a space bar assembly for a computer keyboard, comprising:

an elongate cap adapted for receiving a pressing force;

an actuating post mounted on a bottom of the elongate cap and located substantially at a center thereof;

a pair of locating posts mounted on the bottom of the cap and located respectively substantially at two ends thereof, each said locating post having an upper and lower mounting block, said mounting blocks having confronting ends defining a mounting slot, each of said confronting ends being defined by an inclined short side and an inclined long side intersecting on an apex wherein the short sides are aligned with each other while the long sides are parallel to and spaced from each other a distance;

a hollow key base adapted to be mounted on an IC board, defining a hole extending therethrough for receiving the actuating post to have a reciprocal movement therein;

a pair of locating walls adapted to be mounted on the IC board, each locating wall defining a space for receiving a corresponding locating post to have a reciprocal movement therein;

a pair of mounting seats adapted to be mounted on the IC board, each mounting seat defining a snapping closure; and a supporting member having a first portion and a second portion respectively extending through the mounting slots on the locating posts and a third portion and a fourth portion respectively snappingly received in the snapping closures whereby each of said mounting slots can have enlarged opening ends to facilitate the first and second portions of the supporting member to be extended through the mounting slots.

2. The key assembly in accordance with claim 1, wherein the supporting member is substantially U shaped defining two parallel side portions and an intermediate portion connecting therewith, the two parallel side portions defining respectively the first and second portions of the supporting member, and the intermediate portion having two ends respectively defining the third and fourth portions.

3. The key assembly in accordance with claim 1, wherein each of the locating walls is substantially L shaped.

* * * * *